US008065969B2

(12) United States Patent
Bachmann

(10) Patent No.: US 8,065,969 B2
(45) Date of Patent: Nov. 29, 2011

(54) UNIVERSALLY ATTACHABLE FORWARD TACKING SAIL RIG WITH CANTING INTEGRATED MAST AND WATER FOIL FOR ALL BOATS

(76) Inventor: Helmuth G. Bachmann, Salinas, CA (US)

( * ) Notice: Subject to any disclaimer, the term of this patent is extended or adjusted under 35 U.S.C. 154(b) by 31 days.

(21) Appl. No.: 12/343,387

(22) Filed: Dec. 23, 2008

(65) Prior Publication Data

US 2010/0154695 A1 Jun. 24, 2010

(51) Int. Cl.
*B63B 35/00* (2006.01)

(52) U.S. Cl. ..... 114/39.21

(58) Field of Classification Search .... 114/39.21–39.25, 114/39.27, 39.29, 39.31, 39.32
See application file for complete search history.

(56) References Cited

U.S. PATENT DOCUMENTS

| | | | | |
|---|---|---|---|---|
| 3,041,994 | A | 7/1962 | Brodie | |
| 3,390,656 | A | 7/1968 | Flowers | |
| 3,601,076 | A | 8/1971 | Meeks | |
| 3,839,979 | A | 10/1974 | Wassell | |
| 3,986,473 | A | 10/1976 | Truzzi | |
| 4,082,049 | A | 4/1978 | Nicol | |
| 4,149,481 | A | 4/1979 | Leber | |
| 4,249,276 | A | 2/1981 | Snyderman | |
| 4,367,688 | A | 1/1983 | Godfrey | |
| 4,570,562 | A | 2/1986 | Dudouyt | |
| 4,624,208 | A | 11/1986 | Hyne | |
| 4,750,446 | A | 6/1988 | Sussman | |
| 4,825,790 | A | 5/1989 | Strout | |
| 4,998,498 | A | 3/1991 | Gallichan | |
| 5,188,050 | A | 2/1993 | Latham | |
| 5,410,977 | A | 5/1995 | Webb | |
| 5,908,005 | A | 6/1999 | Everett | |
| 6,016,759 | A * | 1/2000 | Russell | 114/39.21 |
| 6,189,472 | B1 | 2/2001 | Duncan | |
| 6,457,430 | B1 | 10/2002 | Drabkin | |
| 6,923,131 | B2 | 8/2005 | Petrovich | |
| 7,267,065 | B1 | 9/2007 | Short | |
| 2008/0105187 | A1 | 5/2008 | Howes | |

OTHER PUBLICATIONS

Bill Springer, "Boats in Bags", Sail magazine article in Jun. 2005, on p. 58 and 59, Source Interlink Media, USA.
"Swing Rig" by Van De Stadt found in Sail magazine article in Dec. 2008, on p. 49, Source Interlink Media, USA.
U.S. Appl. No. 61/017165, Helmuth G. Bachmann.

* cited by examiner

*Primary Examiner* — Daniel Venne

(57) ABSTRACT

This invention relates to the use of a removably attachable sailing rig with an integrated water foil for the conversion of a conventional boat, row boat, kayak, canoe, and power boat into a sailboat or an existing sailboat rig into a canting sail rig. The sail rig system utilizes the strong attachment points inherently available on most conventional boats and soft inflatable boats for attachment. The sail rig is comprised of a mast with an integrated water foil and is supported by a strut on each side forming a tripod with the mast, a sail is attached to the mast which is unconventionally tacked or jibed around the front of the mast in order to clear the struts. The base of each strut has a strut attachment assembly for direct attachment to an oar lock or shear of a boat. The base of the mast has a mast attachment assembly for direct attachment to the bow or bow towing ring. The mast and water foil can be tilted or canted to either side of the boat by lengthening or shortening each strut. The sail rig system also has a separate rudder assembly for steering.

14 Claims, 14 Drawing Sheets

UNIVERSALLY ATTACHABLE FORWARD TACKING SAIL RIG WITH CANTING INTEGRATED MAST AND WATER FOIL FOR ALL BOATS

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISK APPENDIX

Not Applicable

BACKGROUND OF THE INVENTION

This invention relates to the use of an attachable sail rig with an optional integrated water foil and a rudder for conversion of a conventional boat such as a row boat, kayak, canoe, and power boat into a sailboat or to modify an existing sailboat. The state of the art designs for attachable sailing rig systems limits their use to only specific types of boats and have relatively little sail area for the recommend size of boat, thus lacking in performance and the power required for a planing hull to plane. Generally, the sail area limitation is due to the absence of strong attachment points or mast rig for properly supporting a larger sail rig, especially on inflatable boats. Existing designs also use outboard water foil(s) or lee boards with elaborate attachments to the mast structure which increase the complexity and reduce the versatility and strength, and are unable to cant.

An example of an attachable sail rig which is no longer on the market, has the least amount of complexity using a single forward or bow water foil can be found in SAIL magazine article in June 2005, on page 59. This rig has a C-shaped mast step by Scully Fin which holds the water foil in the front end and mast in the back end, which is also stayed with small lines near the base of the mast. This indirect attachment reduces the rigidity between the mast and water foil, and places the relative center of sail area further aft of the water foil. With the sail area further aft and a fully shaped water foil which is not easily stalled at low speeds, the rig is prone to lock in irons when pointed too far into the wind, especially with a standard rudder. The C-shaped mast step attachment does not utilize the existing bow towing ring/safety line and oar locks for the distribution of the mast loads onto the hull. This rig design, as well as others with more complexity such as those by Sailboats To Go with lee boards (found in SAIL magazine article in June 2005, on page 58 and 59), also limit the strength and rigidity needed to carry additional sail area in strong winds.

Another sail rig which is not detachable and permanently installed on large sailboats is the Swing Rig by Van De Stadt found in SAIL magazine article in December 2008, on page 49. Although, this sail rig can be jibed around the front of the sailboat as a single unit, un-stayed and unsupported above deck. The dissimilarities of this sail rig will be described in this invention, which include a fixed mast rig with support struts and canting ability. Another similar sail rig used in windsurfing is also tacked or jibed around the front of the mast as a single unit and only supported by the sailor, although, unlike most sail rigs the mast and sail can be canted or tilted independently of the hull with the sail's foot optimally close to the water. In strong winds the windsurfing sail rig is canted windward and aft ward, adding to the sail's drag, but the added lift reduces the net weight and water drag on the hull which increases the overall performance. It is one of the most efficient sail rigs because of it's versatility, but unlike other sail rigs the complexity in sail control for water starts, steering, tacking and proper weight distribution requires good physical agility and takes time to master.

Another similar but unrelated sailing configuration can be found in the use of a conventional asymmetrical spinnaker, which can also be setup to tack around the front of a boat's standing rigging or forestay. Although, the sail has a free floating lull and is not tacked around the mast as will be described in this invention.

BRIEF SUMMARY OF THE INVENTION

It is the object of this invention to disclose the drawbacks of existing prior art and to provided a complete universal sail rig which can be removably attached to any type of boat for sailing, and have the fewest components, thus reducing the complexity and cost for manufacturing.

It is a further object to the present invention to provide a sail rig with a novel method for tacking a sail which eliminates the existing restrictions on mast support structures. The mast support structure is comprised of two support struts which are geometrically positioned without restriction for maximum height and stance on each side of the mast, forming a tripod with the mast for maximum strength and simplicity. This support structure geometry is also adjustable in size to utilize a boat's inherently strong attachment points such as oar locks and bow for maximum support strength without restricting the functionality of the sail rig, and have the ability to carry a large sail area in brisk wind conditions. Additionally, the support structure provides a method for canting of the sail to windward and create lift which reduces the net weight of the boat and increases it's overall performance.

It is a further object to the present invention to provided a sail rig with support structure geometry which includes one integral water foil for lateral resistance to the sail and is attached to the base of the mast for simplicity and efficiency, and also provide a method for the attachment of a rudder for steering control on any type of boat. All components of the sail rig disassemble and reduce in size for easy transport by a car or as commercial airline luggage.

These and other features and objects of the invention will become apparent from the following detailed description when taken with the accompanying drawings and claims, of which:

BRIEF DESCRIPTION OF THE SEVERAL VIEWS OF THE DRAWING

Corresponding reference numerals designate corresponding parts throughout several views of the drawings.

DETAILED DESCRIPTION OF THE INVENTION

Figure 1:
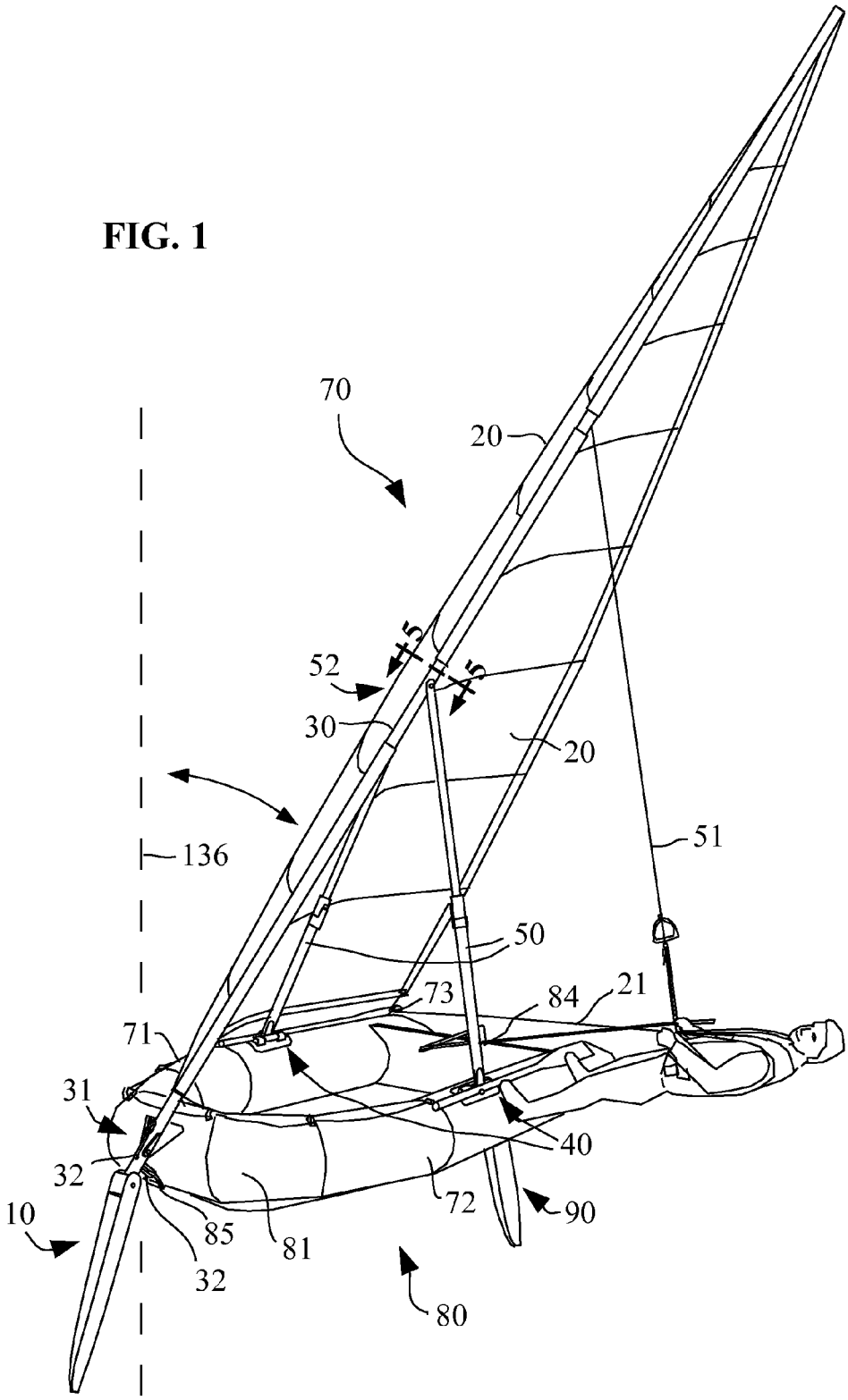
FIG. 1 is a perspective view of a boat and the attachable sail rig embodying the invention.
Figure 2:
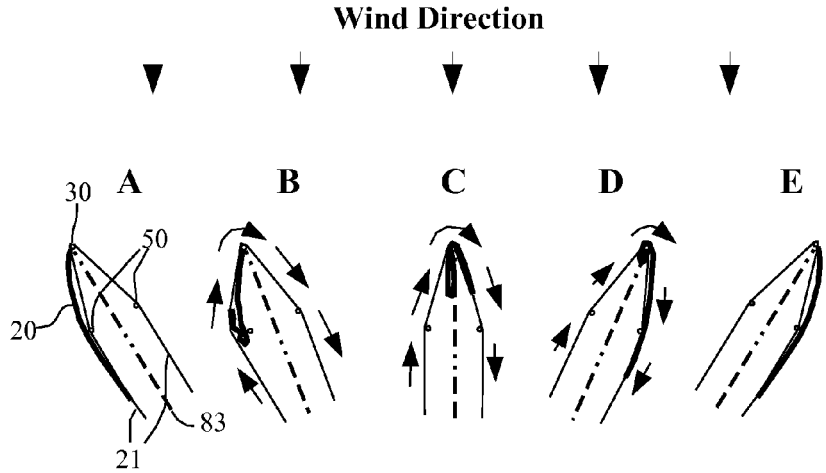
FIGS. 2A through 2E is a sequence of elevational sketched sectional views of the sail rig.
Figure 3:
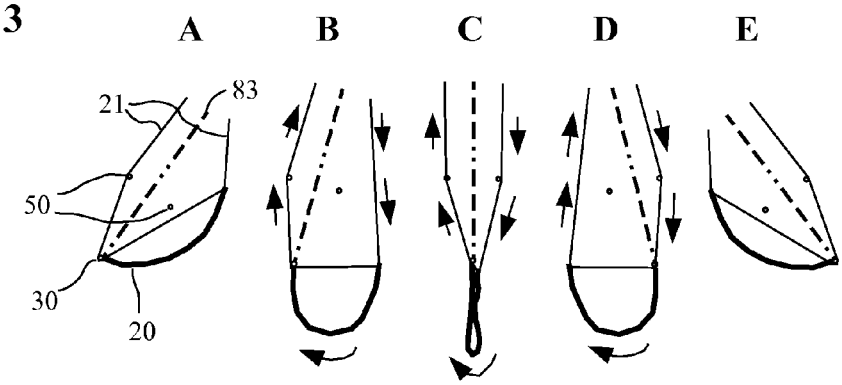
FIGS. 3A through 3E is a different sequence of elevational sketched sectional views thereof.
Figure 4:
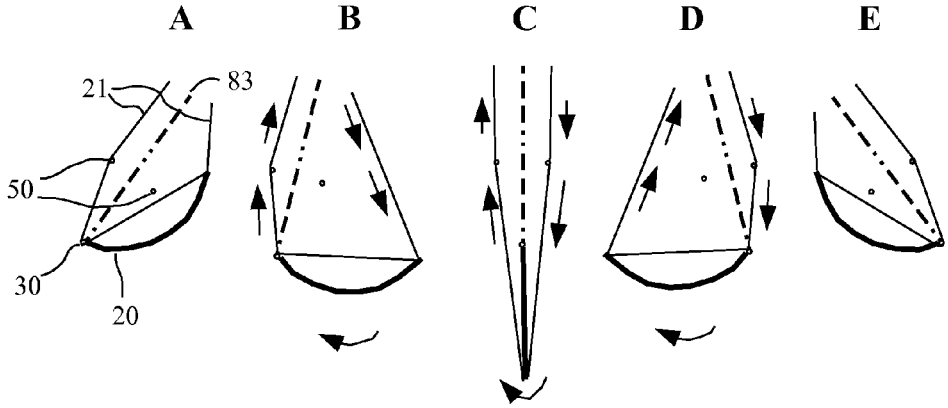
FIGS. 4A through 4E is a different sequence of elevational sketched sectional views including a battened sail or boom.
Figure 5:
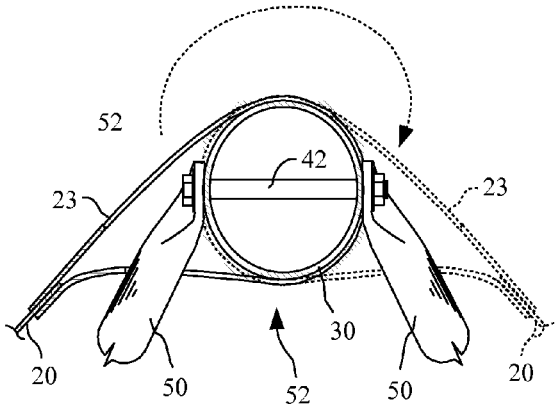
FIG. 5 is a sectional view taken substantially along line 5-5 in FIG. 1 including the strut attachment, mast and sail.
Figure 6:
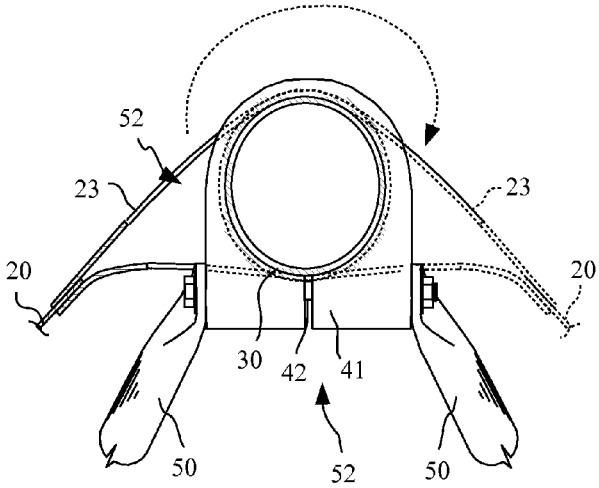
FIG. 6 is a sectional view similar to FIG. 5. including a strut attachment clamp.
Figure 7:
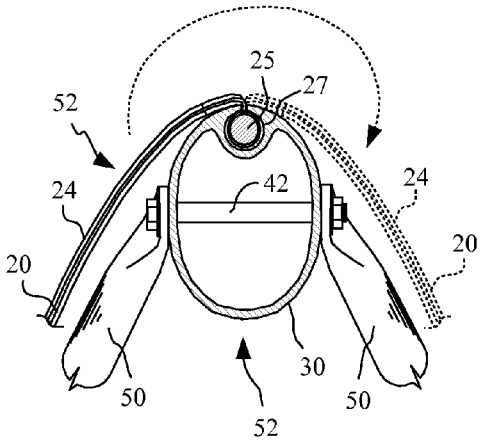
FIG. 7 is a sectional view similar to FIG. 5. including a battened sail and mast groove.

Referring now to the drawings, and more particularly to FIG. 1, a sail rig 70 provided for a boat 80 with a bow 81 and having a transom 84 and a starboard side 71 and a port side 72. The sail rig 70 utilizes the strong attachment points inherently available on most conventional boats and soft inflatable boats for attachment. The sail rig 70 is comprised of a mast 30 with an optional water foil assembly 10 and is supported by a strut 50 attached to each side of the mast 30 with a mast strut attachment assembly 52 forming a tripod with the lower section of the mast 30 and having a sail 20. The base of the starboard strut 50 is attached to the starboard side 71 of the boat 80 aft of the mast 30 and the base of the port strut 50 is symmetrically attached to the port side 72 of the boat 80, both with a strut attachment assembly 40. The base of the mast 30 attaches to the bow 81 of the boat 80 with a mast attachment assembly 31 using a bow attachment line 32 through the bow towing ring 85. On conventional sail rigs the main sail 20 is tacked aft of the mast 30 and the location of each strut 50 would interfere with the sail 20 on a reach or down wind when the sail 20 is let out against each strut 50. If the sail 20 is placed outside or forward of each strut 50 the sail 20 cannot be conventionally tacked aft through each strut 50. However, as the basis of this invention, the sail 20 can be tacked unconventionally around the front of the mast 30 which is clear of any obstructions when tacking upwind as shown from above in FIGS. 2A through 2E, as a sequence of angle changes in the longitudinal axis 83 of a boat 80 with the wind direction indicated by arrows at the top of the page. Tacking or jibing the sail 20 down wind is shown as a sequence in FIGS. 3A through 3E, and as a sequence with a sail 20 having battens or a boom in FIGS. 4A through 4E. Also, if a conventional hiking trapeze wire 51 as shown in FIG. 1 is used for a sailing trapeze, only a single trapeze wire 51 is required and detachment is unnecessary when tacking. Basically, the sail 20 is free of any interference and each strut 50 on all points of sailing. Even when closed hauled, the base of each strut 50 is cleared by the outward curvature or draft of the sail 20 as shown, and allows for the maximum stance and height placement on the mast 30 of each strut 50 on any boat 80. Although, because the sail 20 goes around the front of the mast 30 a main sheet 21 is required for each side of the boat 80 to bring the sail 20 around from port side 72 to starboard side 71 when tacking similar to a conventional jib, as shown. A pulley 73 is attached to each side of the boat 80 near the transom 84 to handle the main sheet 21 as shown in FIG. 1. The sail 20 for this invention can be attached to the mast 30 as shown in FIG. 1 by using several conventional methods as shown in a cross sectional view just above the mast strut attachment assembly 52 as shown in FIG. 5 and similarly in FIGS. 6 and 7 which also show the strut attachment bolt 42. FIG. 5 shows the attachment of the sail 20 to the front side of the mast 30 using a luff pocket 23 which encloses the mast 30, and is open where each strut 50 attaches to mast 30 allowing the luff pocket 23 and sail 20 to rotate around the front of the mast 30. The sail 20 can also have full length battens 24 and cams (not shown in drawings) to induce camber in the sail 20. A conventional windsurfing sail 20 without modification can be used with a strut attachment clamp 41 as shown from the cross sectional view in FIG. 6. A conventional wishbone windsurfing boom can also be used and attached to the mast 30 above the mast strut attachment assembly 52 and rotates around the mast 30 when tacking (not shown in drawings). Another method of attachment for a conventional sail 20 having a luff tape 25 which slides up and down the mast groove 27 is shown in cross sectional view FIG. 7 and the sail 20 can be raised and lowered. The forward attachment point also creates a bend and a preferable camber at the front of the sail 20. If a luff pocket 23 is used, the head of the sail 20 contains a slippery polyethylene plastic cup insert which allows the sail 20 to rotate freely when tacking (not shown in drawings). The tack of each sail 20 is attached with a line leading to the front of the mast 30 base which reduces the tension on the luff when tacking and helps the head of the sail 30 turn more freely (not shown in drawings).

Figure 8:
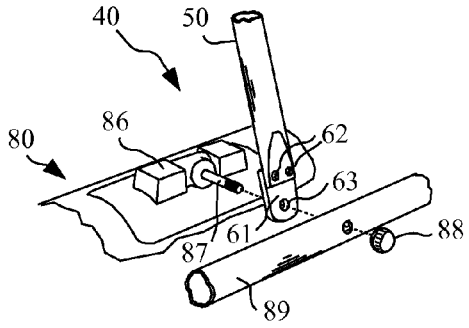
FIG. 8 is an exploded perspective view of an oar lock and strut attachment assembly on an inflatable boat.
Figure 9:
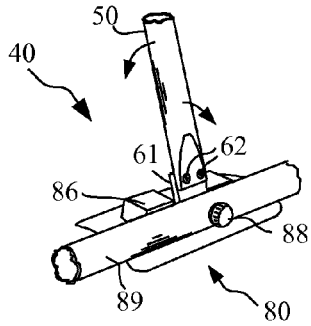
FIG. 9 is an assembled perspective view thereof.
Figure 10:
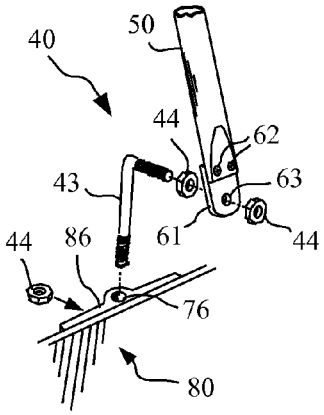
FIG. 10 is an exploded perspective of an oar lock and strut attachment assembly on a row boat.
Figure 11:
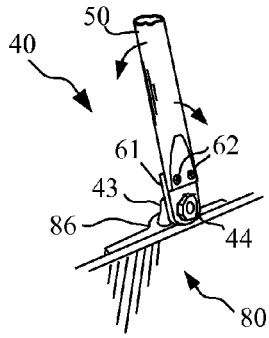
FIG. 11 is an assembled perspective view thereof.
Figure 12:
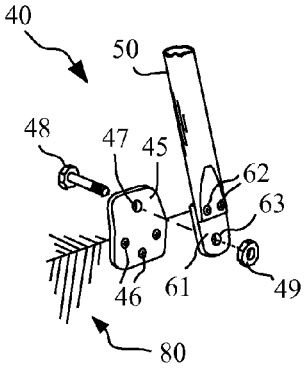
FIG. 12 is an exploded perspective view of a strut attachment assembly on a boat.
Figure 13:
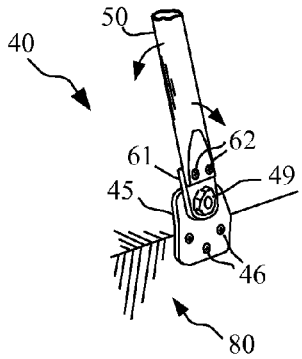
FIG. 13 is an assembled perspective view thereof.
Figure 14:
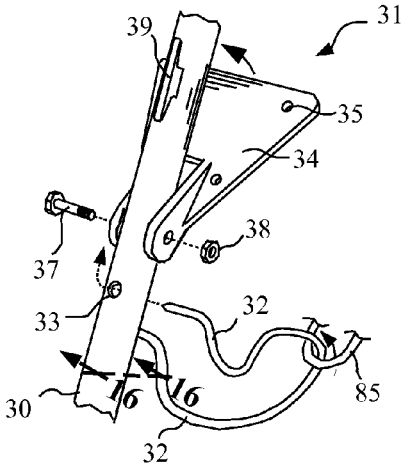
FIG. 14 is an exploded perspective view of the mast attachment assembly.
Figure 15:
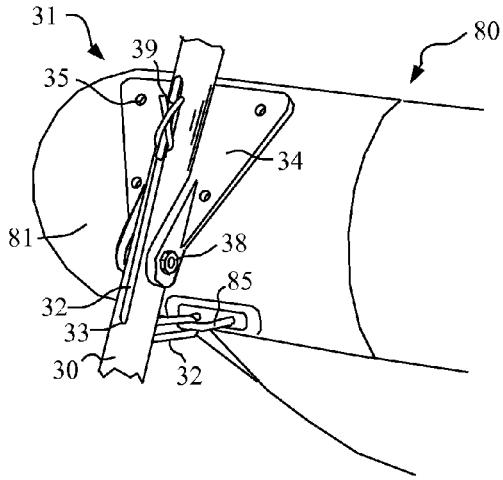
FIG. 15 is a perspective view of the mast attachment assembly attached to the bow of an inflatable boat.
Figure 16:
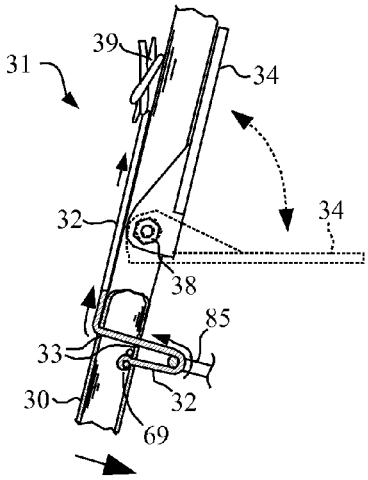
FIG. 16 is a partial sectional side view taken substantially along line 16-16 in FIG. 14 of the mast attachment assembly.
Figure 17:
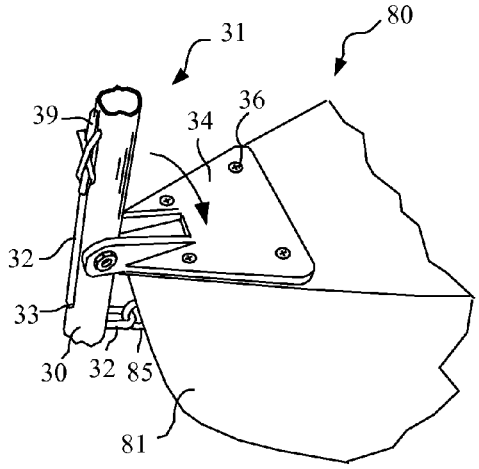
FIG. 17 is a perspective view of the mast attachment assembly attached to the bow of a boat.

One of the most critical components of the sail rig 70 is in the proper attachment of the sail rig 70 to a conventional row boat 80 or power boat 80 or modification of an existing sail boat 80. In order to support a larger sail 20 area the inherently strongest attachment points need to be utilized for each type of boat 80 without restricting the functionality of the sail rig 70. The mast attachment assembly 31 and strut attachment assembly 40 are designed to be adaptable for any type of boat 80 including an inflatable boat 80 as shown in FIG. 1 and to be quickly attachable and detachable. Now referring to FIGS. 8 through 13, the strut attachment assembly 40 at the base of each strut 50 is comprised of a strut end plate 61 made of semi-flexible plastic which is permanently attached to the bottom end of each strut 50 by several strut end plate bolts 62. The strut end plate 61 also has a strut attachment hole 63 on the end which is used to attach to the boat 80 pivotally along the longitudinal axis 83 of the boat 80 which allows the strut 50 to rotate fore and aft and can flex from side to side along the lateral axis as indicated by arrows in FIGS. 8 and 9. For boats with existing oar locks, the strut is attached to the oar lock 86. On an inflatable boat 80 each strut 50 is attached using the existing oar lock pin 87 and oar lock pin nut 88 as shown in FIG. 9. For a conventional row boat 80 without an existing oar lock pin 87 an L-bolt 43 and L-bolt nuts 44 are used to bolt into the oar lock hole 76 of the oar lock 86 and through the strut attachment hole 63 as shown in FIGS. 10 and 11 when assembled. For boats without any oar lock 86 a shear attachment plate 45 is provided with several holes for permanent attachment to the shear of the boat 80 with shear attachment plate bolts 46 as shown in FIG. 12. The strut end plate 61 is then attached to the shear attachment plate 45 using a shear strut attachment plate bolt 48 which goes through the shear strut attachment plate hole 47 and the strut attachment hole 63 which is secured by a shear strut attachment plate nut 49 and allows the strut to rotate as shown in FIG. 13. Now referring to FIGS. 14 through 17 for the attachment of the mast 10 to a boat 80. The mast attachment assembly 31 consists of a detachable mast plate 34 made of a semi-flexible plastic and is pivotally attached to the mast 30 with a mast plate bolt 37 and mast plate nut 38. A bow attachment line 32 is used to attach the mast 30 to the bow 81 of the boat 80 or bow towing ring 85 as shown in FIGS. 14 and 15. On an inflatable boat 80 the mast plate 34 is rotated to the up position which helps hold the water foil assembly 10 in line and pad the mast 30 against the bow 81 of the inflatable boat 80 as shown in FIG. 15. For conventional or non-inflatable boats, the detachable mast plate 34 is rotated down and permanently attached to the bow 81 of a boat 80 through the mast plate holes 35 using mast plate screws 36. The mast 30 is then attached to the detachable mast plate 34 when in use as shown in FIG. 17. The bow attachment line 32 has one end permanently attached inside the base of the mast 30 with a bow attachment line knot 69 as shown in the partial cross sectional view of the mast 30 in FIG. 16. The other end of the bow attachment line 32 is fed through the bow towing ring 85 and back through the bow attachment hole 33 in the mast 30, then up to a mast cleat 39 on the mast 30. The mast 30 is pulled into the bow 81 by tightly pulling the bow attachment line 32 and cleating it off. The combined opposing forces of the water foil assembly 10 and the sail 20 pressure on the mast 30 helps reduce the lateral stress on the mast attachment assembly 31. Although, large inflatable boats and kayaks can require additional bow attachment lines attached to the life lines or other attachment points for additional strength (not shown in drawings). The pivotal and flexible attachments will not compromise the integrity of the boat 80 if dismasted by a strut 50 or mast 30 failure, especially on inflatable boats. If there are no standard or conventional attachment points available on a boat 80, custom attachment may be required for the attachment of the sail rig 70 (not shown in drawings).

Figure 18:
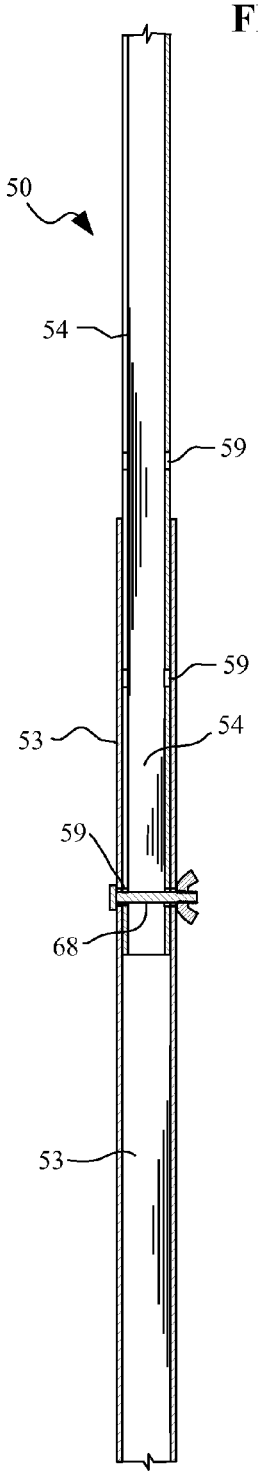
FIG. 18 is a sectional view of strut tubes in longest length adjustment.
Figure 19:
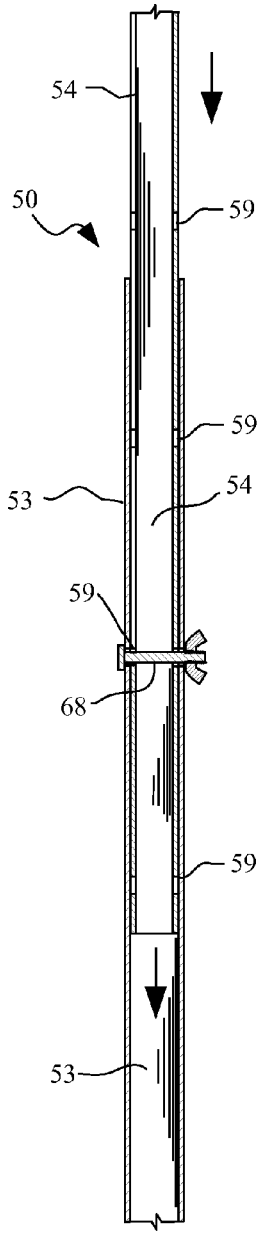
FIG. 19 is a sectional view of strut tubes in medium length adjustment.
Figure 20:
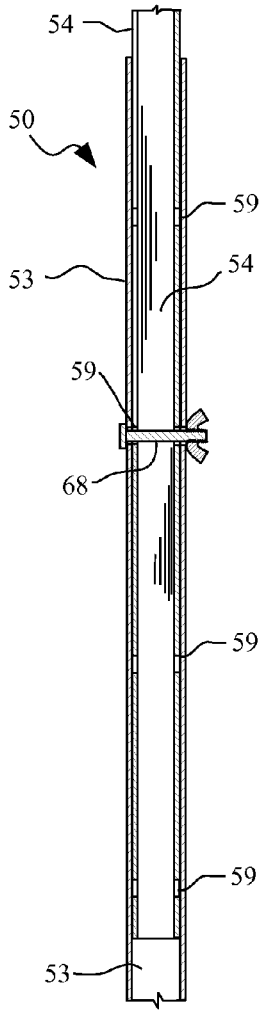
FIG. 20 is a sectional view of strut tubes in shortest length adjustment.
Figure 21:
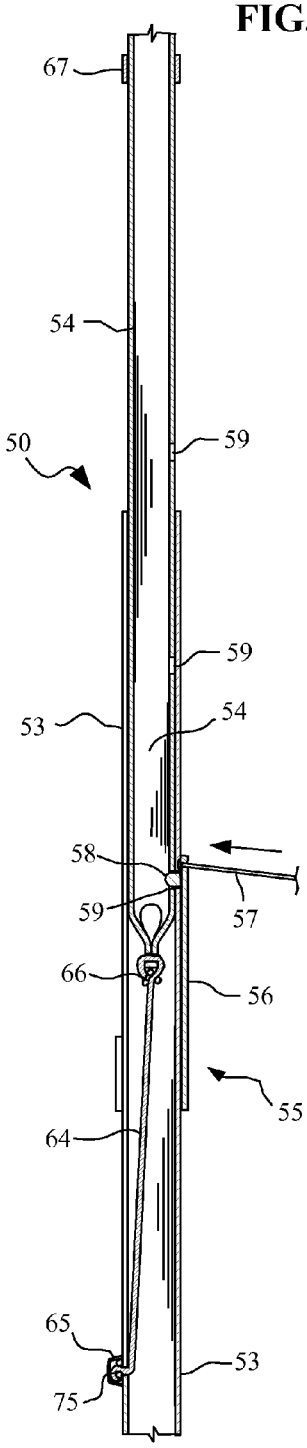
FIG. 21 is a sectional view of strut tubes with locking release mechanism in longest length setting.
Figure 22:
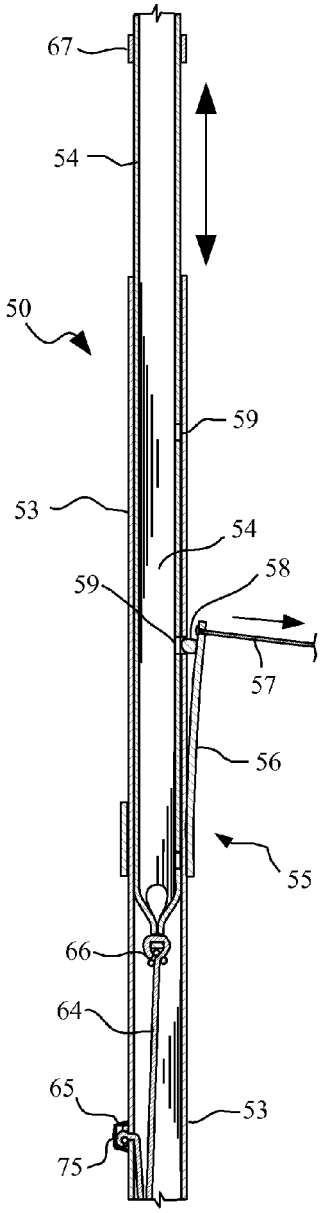
FIG. 22 is a sectional view of strut tubes with locking release mechanism in medium length setting.
Figure 23:
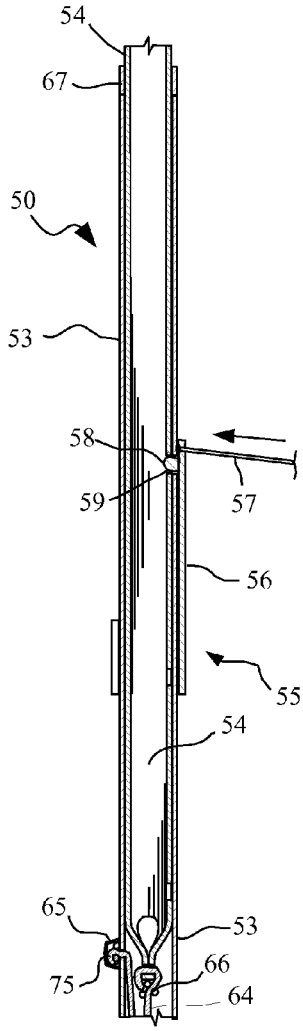
FIG. 23 is a sectional view of strut tubes with locking release mechanism in shortest length setting.
Figure 24:
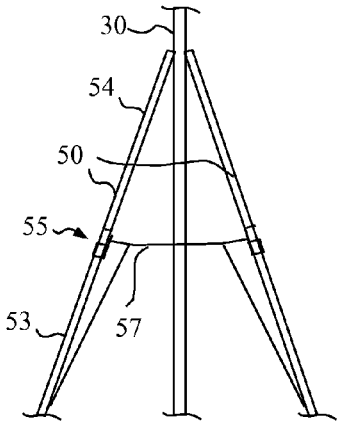
FIG. 24 is a rear view of strut tubes with the mast in the vertical position.
Figure 25:
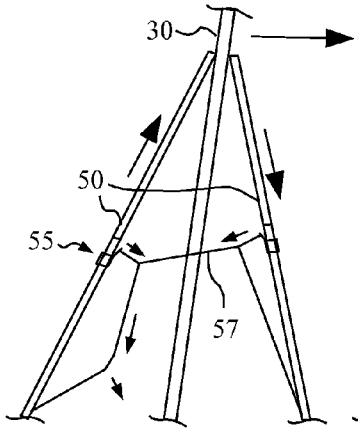
FIG. 25 is a rear view of strut tubes with mast canting.
Figure 26:
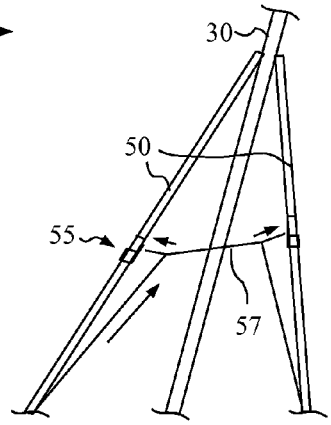
FIG. 26 is a rear view of strut tubes locking with mast canted.
Figure 27:
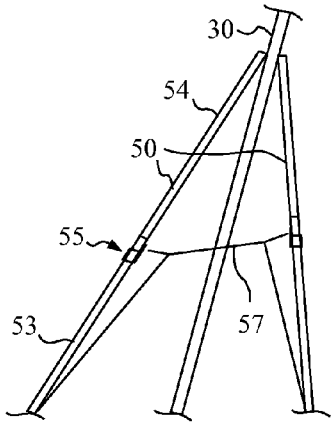
FIG. 27 is a rear view of strut tubes locked with mast canted.
Figure 28:
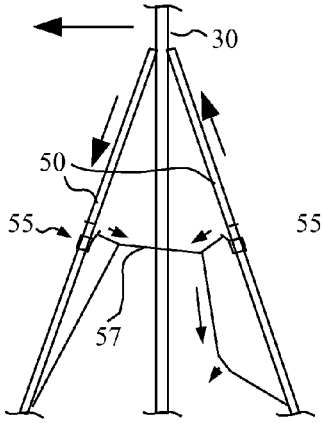
FIG. 28 is a rear view of strut tubes with mast canting.
Figure 29:
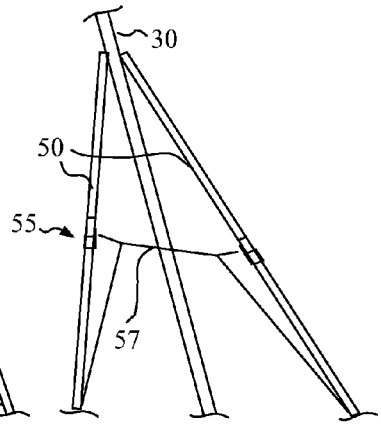
FIG. 29 is a rear view of strut tubes locked with mast canted in reverse direction.
Figure 30:
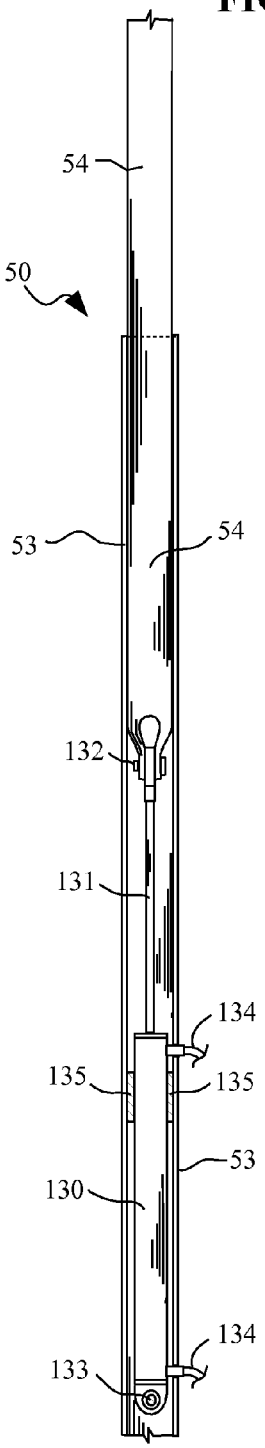
FIG. 30 is a sectional view of strut tubes with hydraulic cylinder in longest length setting.
Figure 31:
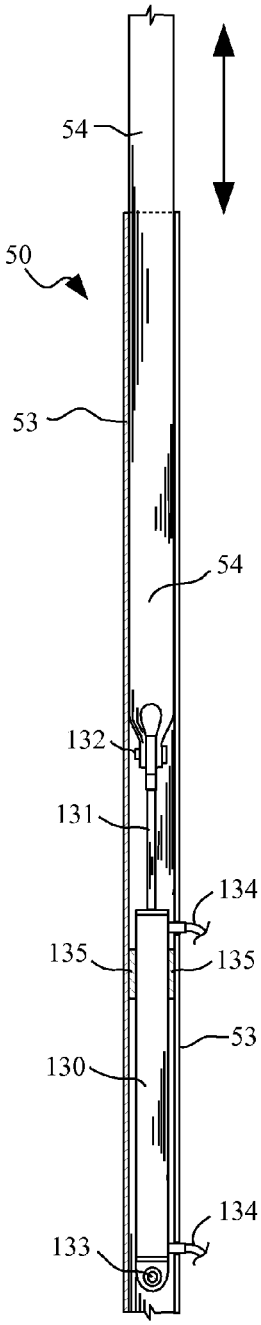
FIG. 31 is a sectional view of strut tubes with hydraulic cylinder in medium length setting.
Figure 32:
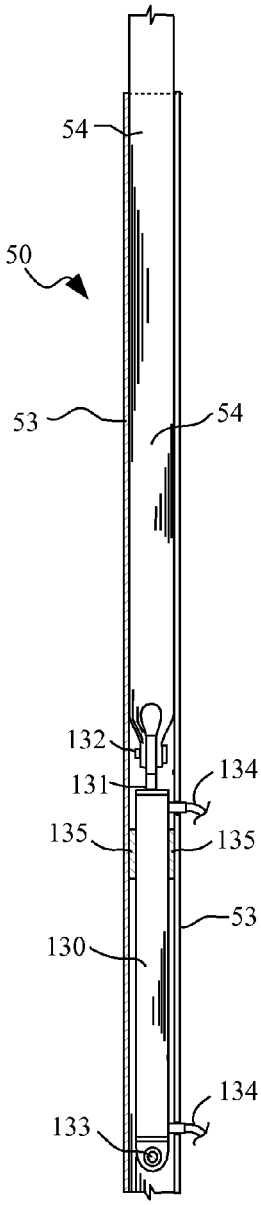
FIG. 32 is a sectional view of strut tubes with hydraulic cylinder in shortest length setting.

Because the location of the strong attachment point on each boat 80 varies in location and scale, the sail rig 70 geometry is adaptable by changing the length of each strut 50 as shown in FIGS. 18 through 20. Where each strut 50 is comprised of two tubes, a lower strut tube 53 having a larger tube diameter which is attached to the boat 80 and an upper strut tube 54 with a smaller tube diameter attached to the mast 30 and telescopes inside or into the larger lower strut tube 53. The telescoping action of the upper strut tube 54 shortens or lengthens each strut 50 by manually selecting a different strut locking hole 59 for the strut adjustment bolt 68 as shown in FIGS. 19 and 20. The length of each strut 50 can also be separately adjusted to different lengths, and the mast 30 and sail 20 can be angled or canted to port and starboard or fore and aft from the vertical axis 136 of the boat 80, with similar positioning as that of a windsurfing sail for efficiency as shown in FIG. 1. Although, in order to accomplish this action quickly while under sail a different design or embodiment is required having a locking release mechanism 55 on the lower strut tube 53 instead of a bolt, as shown in FIGS. 21 through 23. The locking release mechanism 55 is comprised of a flexible release bar 56 attached to the lower tube strut 53 and extended with a lock pin 58 on the end which is lifted out of the strut locking hole 59 by pulling on the release line 57 allows the upper tube strut 53 to telescope up or down as shown in FIG. 22. Full extension of the strut 50 is stopped by the full extension a strut stop line 64 which is attached to the lower strut tube 53 with a lower strut knot 65 having a knot cap 75 and to the upper strut tube 54 with an upper strut knot 66. With the release line 57 released, the lock pin 58 locks into the strut locking hole 59, locking the strut 50 in the extended position as shown in FIG. 21. Full compression of the strut 50 is stopped by a strut stop ring 67 attached to the upper strut tube 54 which stops against the lower strut tube 53 and with the release line 57 released, the lock pin 58 locks into the strut locking hole 59, locking the strut 50 in the compressed position as shown in FIG. 23. The length of the strut 50 can be controlled by the different location for each strut locking hole 59, as shown in FIGS. 24 through 29, starting with the mast 30 in a vertical position as shown in FIG. 24 with each strut 50 set to an equal length, then canting the mast 30 to one side by pulling on a release line 57 which releases each strut 50 during a tack as shown in FIG. 25, then releasing the release line 57 to lock each strut 50 in place as shown in FIG. 26. The boat is then tacked and the mast 30 is now locked and canted to the windward side as shown in FIG. 27. To tack again the process is repeated, the release line 57 is pulled releasing each strut 50 and the mast 30 to the opposite side during a tack as shown in FIG. 28, and then locked when the tack is completed as show in FIG. 29. On extremely large boats the telescoping action of each strut 50 is controlled using a hydraulic cylinder 130 installed in each lower strut tube 53 as shown if FIG. 30. The hydraulic cylinder 130 is attached and held in place with a hydraulic cylinder attachment bolt 133 and hydraulic cylinder spacer ring 135 and the hydraulic cylinder rod 131 is attached to the upper strut tube 54 with a hydraulic cylinder rod pin 132. The hydraulic cylinder rod 131 moves when hydraulic fluid pressure changes in the hydraulic cylinder 130 which is fed by each hydraulic cylinder hose 134 and varies the length for each strut 50 as shown in FIGS. 30 through 32. Each hydraulic cylinder hose 134 on the port side is cross connected to each hydraulic cylinder hose 134 on the starboard side of the boat 80 and move in opposing directions when tacking (not shown in drawings).

Figure 33:
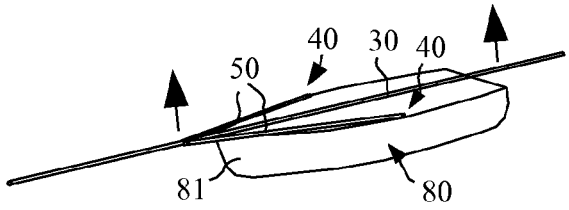
FIG. 33 is a perspective view of each strut and mast attached to a boat.
Figure 34:
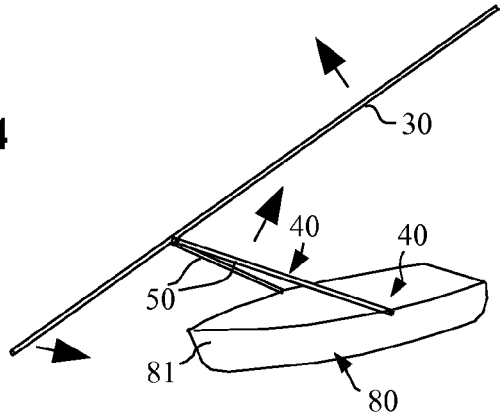
FIG. 34 is a perspective view of each strut and mast being erected.
Figure 35:
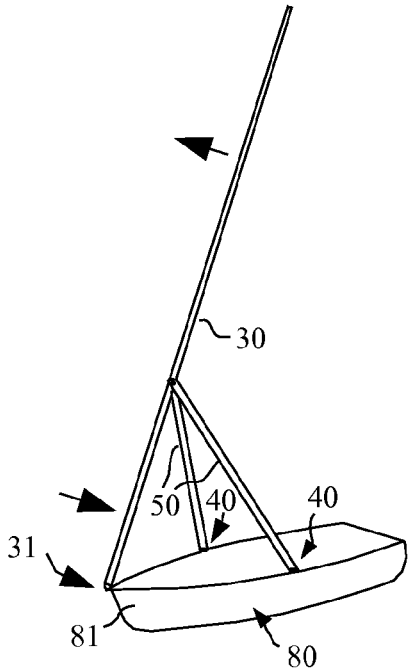
FIG. 35 is a perspective view of each strut and mast fully erected.

Similar to each strut 50 which can be dissembled or shortened, the longer mast 30 is assembled from several smaller interlocking sections which fit inside each other at the ends. This allows the entire sail rig 70 to fit inside a carry bag or a survival kit (not shown in drawings) which can be transported in a car or as luggage on a commercial airlines. The sail rig 70 can be quickly erected on the water from inside the boat 80 or out of the water as shown in FIGS. 33 through 35. First the mast 30 is assembled from the several interlocking sections (not shown in drawings) and the top of each strut 50 is attached to the mast 30 and then the bottom of each strut 50 is attached to the boat 80 with strut attachment assembly 40 as shown in FIG. 33. The mast 30 and each strut 50 rotates at each attachment point when lifted up as shown in FIG. 34, until the base of the mast 30 can be attached to the bow 81 of the boat 80 with a mast attachment assembly 31 as shown in FIG. 35 and fully erected. The mast 30 and each strut 50 is lowered using the same procedure in reverse for disassembly, and attachment assemblies are detached from the boat 80.

Figure 36:
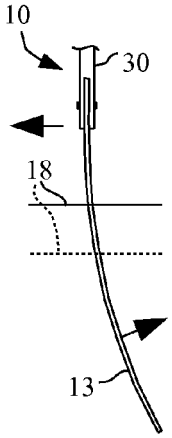
FIG. 36 is a front view of a single water foil on one tack.
Figure 37:
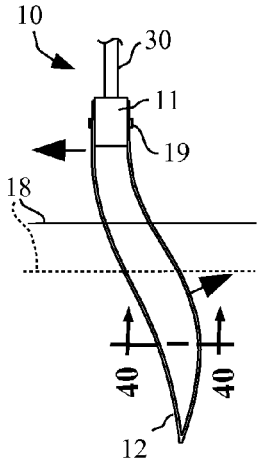
FIG. 37 is a front view of a bi-foil water foil on one tack.
Figure 38:
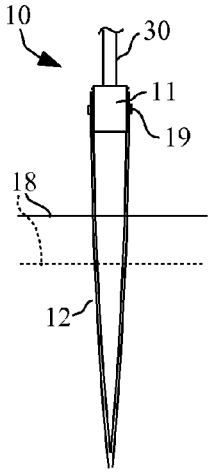
FIG. 38 is a front view of a bi-foil water foil when coming about.
Figure 39:
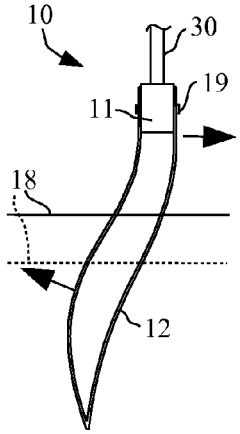
FIG. 39 is a front view of a bi-foil water foil on opposite tack.
Figure 40:
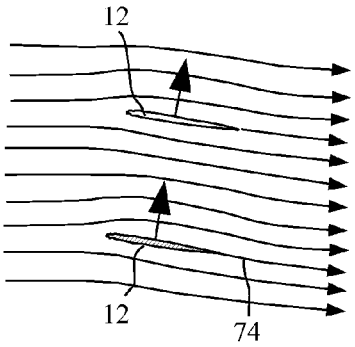
FIG. 40 is a sectional view taken along line 40-40 in FIG. 37 of the bi-foil water foil.
Figure 41:
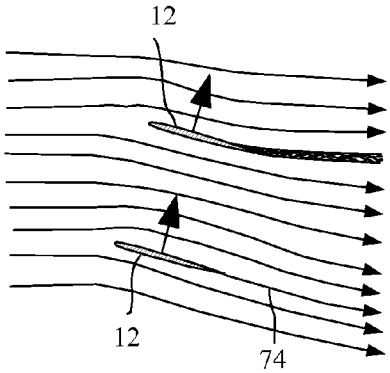
FIG. 41 is a sectional view similar to FIG. 40 with a change in bi-foil water foil angle.
Figure 42:
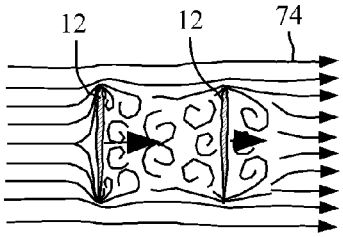
FIG. 42 is a sectional view similar to FIG. 40 with a completely stalled bi-foil water foil.
Figure 43:
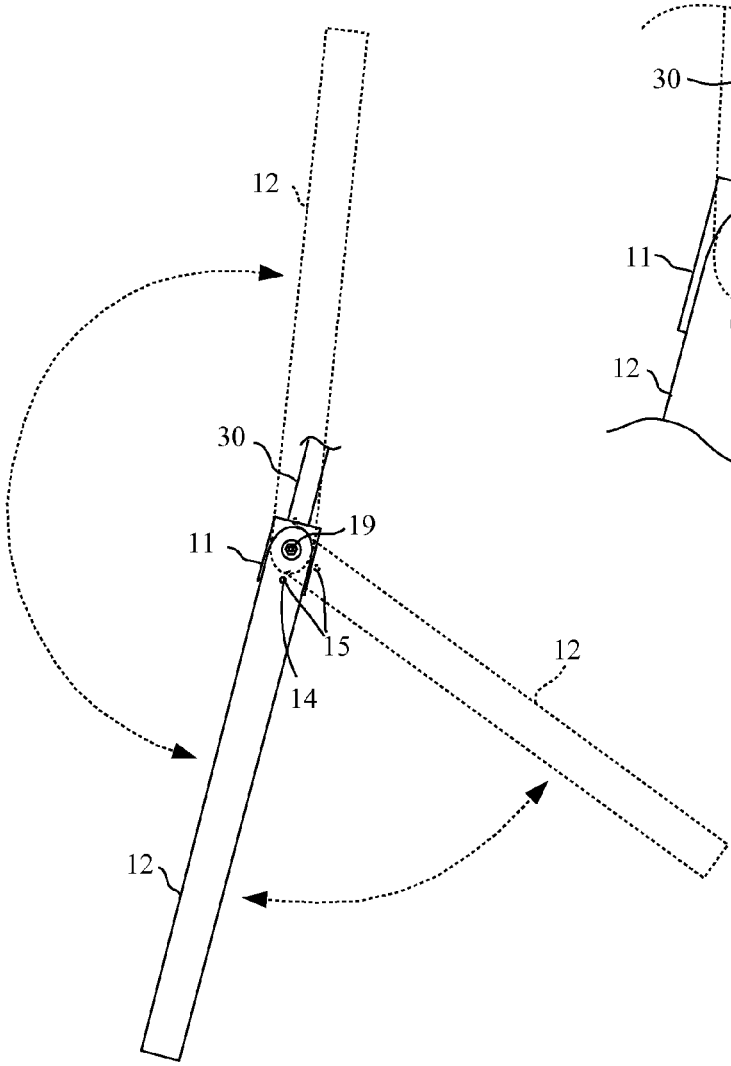
FIG. 43 is a side view of the bi-foil water foil and foil rotational positions.
Figure 44:
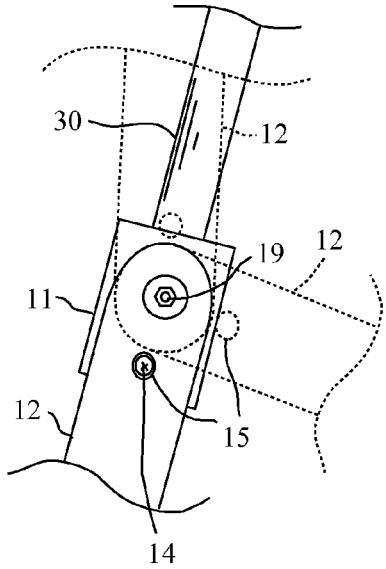
FIG. 44 is an expanded view of the water foil base mount in FIG. 39.

As stated earlier, the sail rig 70 has a water foil assembly 10 for vessels not having a dagger board or a keel as shown in FIG. 1. The water foil assembly 10 is attached to the base of the mast 30 and is able to rotate fore and aft along the longitudinal axis 83 of the boat 80 when not in use. For a boat 80 which can reach planing speeds, any lift generating hydrofoil foil with lateral resistance known to the hydrofoil industry can be used as a water foil assembly 10 to help performance, especially on inflatable boats having a planing hull with an inflatable keel which performs better with the bow 81 lifted from the water. A very different option and a novel part of this invention is a flexible water foil assembly 10 which flexes to create a portion of water foil angled from the vertical axis of the mast 30 when under lateral load and generates a lifting component from a single water foil 13 which are indicated with arrows as shown in FIG. 36. As the water foil assembly 10 lifts the boat 80, the water surface 18 goes down relative to the water foil assembly 10 as represented by the dotted line. But, even a more effective water foil assembly 10 and preferred embodiment is a bi-foil water foil 12 consisting of a pair of single water foil 13 separately attached at the top end to a water foil base mount 11 using a base mount bolt 19 with washers and joined at the bottom end to each other as shown in FIGS. 37 through 39. The arrows indicate the force vectors on one tack as shown in FIG. 37, when coming about as shown in FIG. 38 and on the opposite tack as shown in FIG. 39. The junction of a pair of single water foil 13 to form the bi-foil water foil 12 adds to the lateral strength as a unit requiring less thickness of each water foil for strength which is more hydrodynamically efficient at high speeds, as shown in the cross section of the bi-foil water foil 12 in FIGS. 40 and 41, where the large arrows again indicate the lift vectors and the small arrows indicate the water flow 74. The two narrow width high profile foils combine to have nearly the same area and lift of a conventional single foil of twice the width. In turn, the draft or thickness of each foil can be less than half of a single foil because of it's narrow width and high profile. Additionally, at high speeds the interaction of the windward bi-foil water foil 12 helps prevent the detachment of water flow 74 at the aft end of the leeward bi-foil water foil 12 which will maintain lift at a higher angle of attack as shown on the bottom bi-foil water foil 12 in FIG. 41. Also, each thin bi-foil water foil 12 bends under lateral load and curves to form a more efficient foil shape that acts as a lifting hydrofoil along the top section and cups at the bottom section to provide better hold when the foil is partially removed from the water surface 18 (dotted line), especially when reaching as shown in FIGS. 37 and 39. At low speeds the bi-foil water foil 12 will stall sooner and have less resistance then a single foil counterpart because of it's high profile and the leeward water foil blankets the windward foil, which will have less drag when completely stalled as shown in FIG. 42. This reduces the likelihood of getting locked in irons when sailing with a forward water foil assembly 10. When not in use or stowed, the bi-foil water foil 12 is rotated up against the mast 30 as shown in FIG. 43 and in expanded view 44. For deployment into the water the bi-foil water foil 12 is manually rotated down and automatically locks in place nearly in-line with the axis of the mast 30 as shown in FIG. 43 and in expanded view as shown in FIG. 44. The water foil locking mechanism consists of screws on each side of the water foil base mount 11 with protruding lock screw heads 14 and matching lock screw holes 15 on each side of the bi-foil water foil 12. The flexible bi-foil water foil 12 slides on top of the lock screw heads 14 when rotated, except when the lock screw heads 14 and the lock screw holes 15 line up, the lock screw heads 14 go into the lock screw holes 15 which partially locks the bi-foil water foil 12 in place at the proper angle for sailing in the down position as shown in FIG. 44. If an underwater obstruction or beach is encountered while sailing, the rotational force of the bi-foil water foil 12 disengages the locking force and the bi-foil water foil 12 rotates freely to clear the obstruction as indicated with dotted lines. The bi-foil water foil 12 can also be manually rotated forward and up against the mast 30 and out of the water for beaching as shown in FIG. 43.

Figure 45:
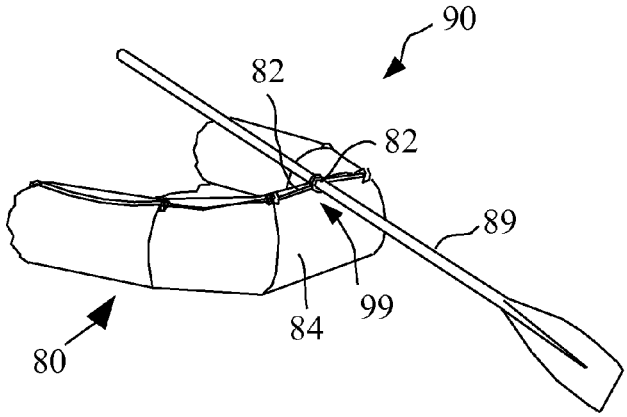
FIG. 45 is a perspective view of a transom including a rudder assembly.
Figure 46:
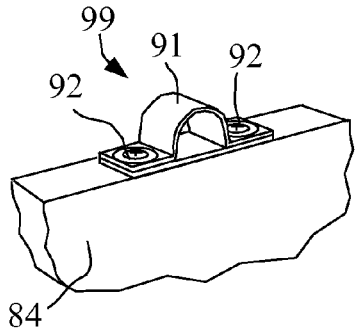
FIG. 46 is a perspective view of an oar lock strap.
Figure 47:
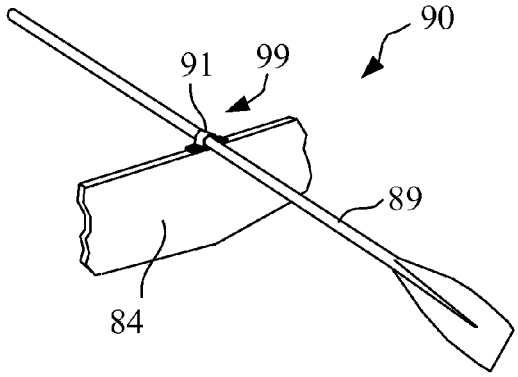
FIG. 47 is a perspective view of a transom including a rudder assembly with an oar lock strap.
Figure 48:
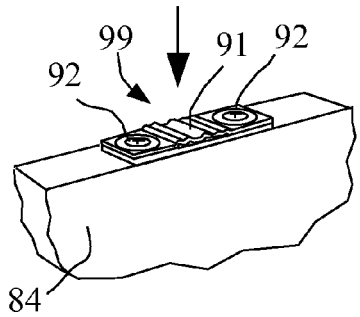
FIG. 48 is a perspective view similar to FIG. 46 of a flattened down oar lock strap.
Figure 49:
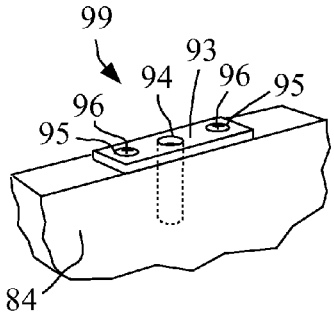
FIG. 49 is a perspective view of a gudgeon plate.
Figure 50:
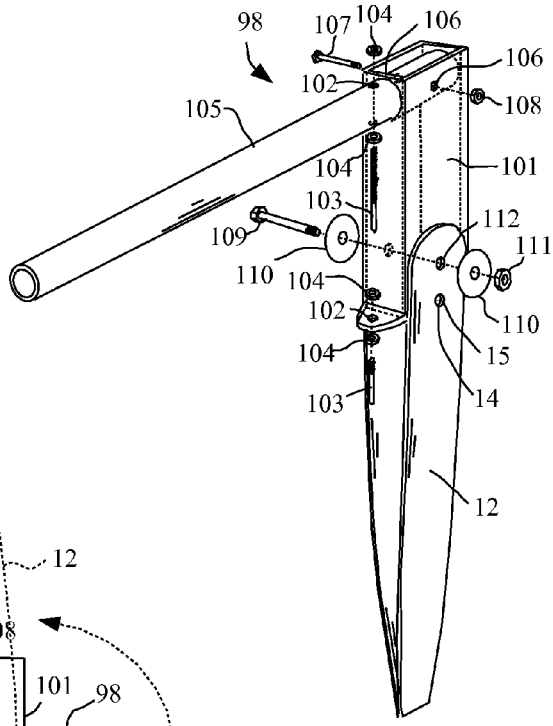
FIG. 50 is a exploded perspective view of a bi-foil rudder.
Figure 51:
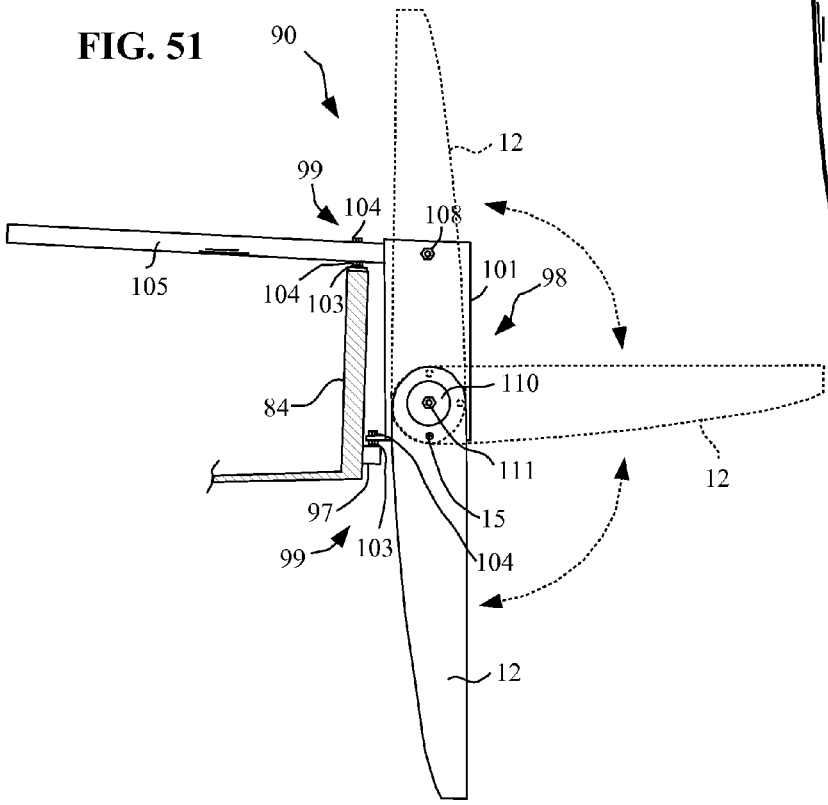
FIG. 51 is a side view of a bi-foil rudder and foil rotational positions.

Referring now to FIGS. 45 through 51, an independent component of the sail rig 70 which is used to control the direction of the boat 80 is the rudder assembly 90. An existing oar 89 which is normally used for rowing can be used for a rudder assembly 90 on a small boat with minimal sail 20 area, especially on a small inflatable boat not having a solid transom 84, the oar 89 is attached centrally to the transom 84 using a rudder attachment assembly 99 which consists of two rudder loop lines 82 attached to the life lines of the boat as shown in FIG. 45. For a boat 80 having a solid transom 84, the rudder attachment assembly 99 consists of an oar lock strap 91 attached to the transom 84 with two strap screws 92 having large washers which holds the oar 89 in place, much like a complete oar lock as shown in FIGS. 46 and 47. The oar lock strap 91 is made of a flexible strapping material with a loop which flattens down when an outboard motor (not shown in drawings) is mounted on top as shown in FIG. 48. For larger boats having a transom 84 and large sail 20 area, a conventional rudder assembly 90 is necessary for added control of the large sail rig 70. A rudder attachment assembly 99 is used which consists of a solid top gudgeon plate 93 and standard bottom gudgeon 97. The top gudgeon plate 93 has a gudgeon hole 94 and two gudgeon screw holes 95 for attachment with gudgeon screws 96 as shown in FIGS. 49 and 51. The gudgeon plate 93 is permanently screwed onto the top of the transom 84, and the transom 84 is drilled to continue the gudgeon hole 94 into the transom 84 (shown as a dotted line) for a removable rudder pintle to be inserted. The top gudgeon plate 93 will not interfere with the placement of an outboard motor. The bottom gudgeon 97 is a standard generic gudgeon that is permanently bolted onto the transom 84 used for the removable rudder attachment of the lower rudder pintle. The rudder assembly 90 can use a standard convention single foil rudder attached to the boat 80 using standard pintles (not shown in drawings). Another option and a novel part of this invention and preferred embodiment of the rudder assembly 90 for larger boats with transoms, comprises a bi-foil rudder 98 which has the same type of foil design as the bi-foil water foil 12 attached to the mast 30, although wider and larger as shown in FIG. 50. The bi-foil rudder 98 consists of a rudder body 101 which is manufactured from a cut rectangular extrusion with a bent flange at the bottom having a pintle hole 102 which holds the lower pintle rod 103 and pintle nut 104 assembly for the lower pintle. The rudder tiller 105 is removable and fits into the tiller hole 106 of the rudder body 101 and is secured in place with a tiller bolt 107 and tiller nut 108. The rudder tiller 105 has a pintle hole 102 to hold the top pintle rod 103 and pintle nut 104 assembly as shown in FIG. 50. The bi-foil water foil 12 is attached to the rudder body 101 pivotally through the bi-foil hole 112 in the same manner as the forward bi-foil water foil 12 using a bi-foil bolt 109, bi-foil washer 110 and bi-foil nut 111, and having the same water foil locking mechanism with the lock screw heads 14 and lock screw holes 15. The bi-foil rudder 98 is attached to the transom 84 using the top gudgeon plate 93 and lower gudgeon 97 as shown in FIG. 51.

The present invention has been fully described by way of example with the accompanying drawings. Various alternations and changes can be made without departing from the spirit and broader aspects of the invention as set forth in the appending claims, which are to be interpreted in accordance with the principles of patent law including the doctrine of equivalents.

REFERENCE NUMERAL TABLE

Numeral Description 10 water foil assembly 11 water foil base mount 12 bi-foil water foil 13 single water foil 14 lock screw heads 15 lock screw holes 18 water surface 19 base mount bolt 20 sail 21 main sheet 23 luff pocket 24 full length battens 25 luff tape 27 mast groove 30 mast 31 mast attachment assembly 32 bow attachment line 33 bow attachment hole 34 mast plate 35 mast plate holes 36 mast plate screws 37 mast plate bolt 38 mast plate nut 39 mast cleat 40 strut attachment assembly 41 strut attachment clamp 42 strut attachment bolt 43 L-bolt 44 L-bolt nuts 45 shear attachment plate 46 shear attachment plate bolts 47 shear strut attachment plate hole 48 shear strut attachment plate bolt 49 shear strut attachment plate nut 50 strut 51 trapeze wire 52 mast strut attachment assembly 53 lower strut tube 54 upper strut tube 55 locking release mechanism 56 flexible release bar 57 release line 58 lock pin 59 strut locking hole 61 strut end plate 62 strut end plate bolts 63 strut attachment hole 64 strut stop line 65 lower strut knot 66 upper strut knot 67 strut stop ring 68 strut adjustment bolt 69 bow attachment line knot 70 sail rig 81 bow 82 rudder loop lines 83 longitudinal axis 84 transom 85 bow towing ring 86 oar lock 87 oar lock pin 88 oar lock pin nut 98 oar 71 starboard side 72 port side 73 pulley 74 water flow 75 knot cap 76 oar lock hole 80 Boat 90 rudder assembly 91 oar lock strap 92 strap screws 93 top gudgeon plate 94 gudgeon hole 95 gudgeon screw holes 96 gudgeon screws 97 lower gudgeon 98 bi-foil rudder 99 rudder attachment assembly 101 rudder body 102 pintle hole 103 pintle rod 104 pintle nut 105 rudder tiller 106 tiller hole 107 tiller bolt 108 tiller nut 109 bi-foil bolt 110 bi-foil washer 111 bi-foil nut 112 bi-foil hole 130 hydraulic cylinder 131 hydraulic cylinder rod 132 hydraulic cylinder rod pin 133 hydraulic cylinder attachment bolt 134 hydraulic cylinder hose 135 hydraulic cylinder spacer ring 136 vertical axis Reference Numeral Table

| | |
|---|---|
| 10 | water foil assembly |
| 11 | water foil base mount |
| 12 | bi-foil water foil |
| 13 | single water foil |
| 14 | lock screw heads |
| 15 | lock screw holes |
| 18 | water surface |
| 19 | base mount bolt |
| 20 | sail |
| 21 | main sheet |
| 23 | luff pocket |
| 24 | full length battens |
| 25 | luff tape |
| 27 | mast groove |
| 30 | mast |
| 31 | mast attachment assembly |
| 32 | bow attachment line |
| 33 | bow attachment hole |
| 34 | mast plate |
| 35 | mast plate holes |
| 36 | mast plate screws |
| 37 | mast plate bolt |
| 38 | mast plate nut |
| 39 | mast cleat |
| 40 | strut attachment assembly |
| 41 | strut attachment clamp |
| 42 | strut attachment bolt |
| 43 | L-bolt |
| 44 | L-bolt nuts |
| 45 | shear attachment plate |
| 46 | shear attachment plate bolts |
| 47 | shear strut attachment plate hole |
| 48 | shear strut attachment plate bolt |
| 49 | shear strut attachment plate nut |
| 50 | strut |
| 51 | trapeze wire |
| 52 | mast strut attachment assembly |
| 53 | lower strut tube |
| 54 | upper strut tube |
| 55 | locking release mechanism |
| 56 | flexible release bar |
| 57 | release line |
| 58 | lock pin |
| 59 | strut locking hole |
| 61 | strut end plate |
| 62 | strut end plate bolts |
| 63 | strut attachment hole |
| 64 | strut stop line |
| 65 | lower strut knot |
| 66 | upper strut knot |
| 67 | strut stop ring |
| 68 | strut adjustment bolt |
| 69 | bow attachment line knot |
| 70 | sail rig |
| 81 | bow |
| 82 | rudder loop lines |
| 83 | longitudinal axis |
| 84 | transom |

-continued

| Reference Numeral Table | |
|---|---|
| 85 | bow towing ring |
| 86 | oar lock |
| 87 | oar lock pin |
| 88 | oar lock pin nut |
| 98 | oar |
| 71 | starboard side |
| 72 | port side |
| 73 | pulley |
| 74 | water flow |
| 75 | knot cap |
| 76 | oar lock hole |
| 80 | Boat |
| 90 | rudder assembly |
| 91 | oar lock strap |
| 92 | strap screws |
| 93 | top gudgeon plate |
| 94 | gudgeon hole |
| 95 | gudgeon screw holes |
| 96 | gudgeon screws |
| 97 | lower gudgeon |
| 98 | bi-foil rudder |
| 99 | rudder attachment assembly |
| 101 | rudder body |
| 102 | pintle hole |
| 103 | pintle rod |
| 104 | pintle nut |
| 105 | rudder tiller |
| 106 | tiller hole |
| 107 | tiller bolt |
| 108 | tiller nut |
| 109 | bi-foil bolt |
| 110 | bi-foil washer |
| 111 | bi-foil nut |
| 112 | bi-foil hole |
| 130 | hydraulic cylinder |
| 131 | hydraulic cylinder rod |
| 132 | hydraulic cylinder rod pin |
| 133 | hydraulic cylinder attachment bolt |
| 134 | hydraulic cylinder hose |
| 135 | hydraulic cylinder spacer ring |
| 136 | vertical axis |

I claim:

1. An attachable sail rig provided for a boat having a longitudinal axis and a vertical axis, a bow, a bow towing ring, a transom, and a port and starboard side, a shear, and a fore and aft end, with said boat in the water having a water surface, comprising:

a mast with a base located at one end having a lower section and a front side facing said bow, and an axis parallel to said mast and said vertical axis of said boat when said mast is vertical;

a mast attachment assembly on said base of said mast providing pivotal attachment to said bow;

a strut on said port side and said starboard side of said boat each having a base and an upper end and a lower end;

a strut attachment assembly on said base of said strut providing pivotal attachment of said strut, enabling each said strut to pivot relative to said port and starboard side of said boat when attached to said boat thereof;

a mast strut attachment assembly on said mast providing pivotal attachment of said upper end of each said strut to said mast above said base of said mast, forming a tripod with said lower section of said mast and enabling each said strut to pivot relative to said mast;

a sail having a luff and said luff attached to said mast with said sail on said front side of said mast outboard of each said strut, enabling said sail with said luff to be tacked or jibed completely around said front side of said mast and each said strut from said port side to said starboard side of said boat and back;

a water foil assembly mounted pivotal substantially along the longitudinal axis of said boat on said base of said mast extending in front of said bow below said water surface, enabling an operative position to resist lateral wind forces and to retract from the operative position in an inoperative position above said water surface, and removable from said base of said mast;

a rudder assembly pivotally mounted on said transom of said boat extending below said water surface, enabling an operative position to resist lateral wind forces and provide steering of said boat and to retract from the operative position in an inoperative position above said water surface.

2. A sail rig recited in claim 1 wherein said strut attachment assembly comprises a strut attachment hole through said base of each said strut wherein said boat having an oar lock on said port and starboard side, and said oar lock having an oar lock pin with an oar lock pin nut for attachment of said oar, and said oar lock pin is accepted by said strut attachment hole pivotal substantially along said longitudinal axis of said boat, and secured with said oar lock pin nut enabling attachment and detachment of each said strut.

3. A sail rig recited in claim 1 wherein said strut attachment assembly comprises a strut attachment hole through said base of each said strut, a L-bolt provided having two threaded ends to accept L-bolt nuts, and one end of said L-bolt is accepted by said strut attachment hole pivotal substantially along said longitudinal axis of said boat, wherein said boat having an oar lock on said port and starboard side and said oar lock having an oar lock hole for attachment of said oar, and the other end of said L-bolt accepted by said oar lock hole and both ends secured by removable said L-bolt nuts enabling attachment and detachment of each said strut.

4. A sail rig recited in claim 1 wherein said strut attachment assembly comprises a strut attachment hole through said base of each said strut, a shear strut attachment plate bolt having a nut, a shear attachment plate having two ends, a bottom end permanently mounted on said shear of said boat, and a top end having a shear strut attachment plate hole, and said shear strut attachment plate bolt accepted by said shear strut attachment plate hole and said strut attachment hole through said base of said strut, pivotal substantially along said longitudinal axis of said boat, and secured by removable said nut enabling attachment and detachment of each said strut.

5. A sail rig recited in claim 1 wherein said mast attachment assembly comprises a bow attachment line having two ends, one end having a bow attachment line knot and one free end, a mast cleat on said mast, a bow attachment hole through said base of said mast, and a mast plate having a plurality of mast plate holes and pivotally attached to said base of said mast facing said aft, enabling an up position proximal to said mast and a down position distal to said mast, and said mast plate is detachable from said mast, and said bow attachment line is permanently attached inside said base of said mast with said bow attachment line knot and said free end passed through said bow towing ring and said bow attachment hole on said mast to said mast cleat, for securing said mast with said mast plate in the up position against said boat when inflatable, captively retaining said water foil assembly substantially parallel to said longitudinal axis of said boat and said mast pivotally to said bow, and enabling the attachment and detachment of said mast.

6. A sail rig recited in claim 5 including a plurality of mast plate screws and said mast plate is permanently mounted on said bow in said down position through said plurality of mast plate holes utilizing said mast plate screws, and said mast is pivotal relative to said mast plate on said boat thereof.

7. A sail rig recited in claim 1 wherein each said strut is comprised of an upper strut tube and a lower strut tube, one telescoping into the other providing adjustment in length of said strut.

8. A sail rig recited in claim 7 including a locking release mechanism for locking and releasing said upper and lower strut tube at predetermined lengths of said strut, enabling said port and starboard side said strut to be locked at different lengths, canting said mast to said port and starboard side and said fore and aft from the vertical axis of said boat on each sailing tack, whereby canting said mast windward and aft to increase the efficiency of said sail.

9. A sail rig recited in claim 8 wherein said locking release mechanism comprises a lock pin, a flexible release bar having two ends, one end having said lock pin and the other end mounted to said strut, and said strut having a strut locking hole through each said upper and lower strut tube accepting said lock pin in a locked position, and said flexible release bar enabling retraction of said lock pin from each said strut locking hole in an unlocked release position when said end having said lock pin is lifted manually, whereby locking and releasing said upper and lower strut tube by hand.

10. A sail rig recited in claim 7 including a hydraulic cylinder having two ends, one end connected to said upper strut tube, and the other end to said lower strut tube for hydraulic adjustment in length of each said strut, enabling said port and starboard side said strut to be adjusted to different lengths, canting said mast to said port and starboard side and said fore and aft from the vertical axis of said boat on each sailing tack, whereby canting said mast windward and aft to increase the efficiency of said sail.

11. A sail rig recited in claim 1 wherein said mast strut attachment assembly comprises a strut attachment bolt accepted by each end of said upper end of each said strut and said mast pivotal substantially along the longitudinal axis of said boat, enabling each said strut to pivot relative to said mast when attached with said strut attachment bolt, whereby providing pivotal movement during the erection of said sail rig and canting of said mast.

12. A sail rig recited in claim 1 wherein said water foil assembly comprises a water foil base mount mounted on said base of said mast, a bi-foil water foil comprising a pair of single water foil, each having a top section terminated by a top end and a bottom section terminated by a bottom end, and each bottom end is connected together forming an intersection, and each top end is pivotally attached to and separated by said water foil base mount, and under lateral load resisting lateral wind forces each said single water foil flexes enabling the top section to be angled from said axis of said mast, providing a lift component helping to lift said bow, and the bottom section to be substantially parallel to said axis of said mast substantially resisting lateral wind forces when said boat is underway, and said water foil base mount separating each said single water foil providing hydrodynamic interaction of the windward said single water foil preventing detachment of water flow at the aft end of the leeward said single water foil, when resisting lateral wind forces from windward.

13. A sail rig recited in claim 1 wherein said rudder assembly comprises a rudder body, a rudder tiller, a pair of pintle rods, a top gudgeon plate and a lower gudgeon, and a bi-foil water foil comprising a pair of single water foil each having a top section terminated by a top end and a bottom section terminated by a bottom end, and each bottom end is connected together forming an intersection, and each top end is pivotally attached to and separated by said rudder body, and said rudder tiller is connected to said rudder body having one said pintle rod proximal to said rudder body, and the other said pintle rod on said rudder body proximal to said bi-foil water foil, both respectively received by said top gudgeon plate and said lower gudgeon mounted on said transom providing pivotal steering on said boat when underway, and under lateral load to resist lateral wind forces each said single water foil flexes enabling each top section to be angled from said vertical axis of said boat, providing a lift component helping to lift said transom, and a portion of water foil in said bottom section substantially parallel to the vertical axis of said boat substantially resisting lateral wind forces, and said rudder body separating each said single water foil providing hydrodynamic interaction of the windward said single water foil preventing detachment of water flow at the aft end of the leeward said single water foil, when resisting lateral wind forces from windward.

14. A sail rig recited in claim 1 wherein said rudder assembly comprises said oar of said boat, and an oar lock strap mounted on top of said transom having a loop which is flexible and closed flat in an inoperative position and open in an operative position centrally accepting said oar, similar to said oar lock of said boat, enabling said oar to pivot relative to said transom of said boat providing steering and lateral resistance for said boat, whereby oar lock strap will not interferer with the mounting of an outboard motor on said transom in the flat inoperative position.

* * * * *